US010786059B1

(12) United States Patent
DoCouto

(10) Patent No.: US 10,786,059 B1
(45) Date of Patent: Sep. 29, 2020

(54) HAIR BRAIDING DEVICE

(71) Applicant: Jocelyn Azevedo DoCouto, Pawtucket, RI (US)

(72) Inventor: Jocelyn Azevedo DoCouto, Pawtucket, RI (US)

( * ) Notice: Subject to any disclaimer, the term of this patent is extended or adjusted under 35 U.S.C. 154(b) by 0 days.

(21) Appl. No.: 16/398,991

(22) Filed: Apr. 30, 2019

(51) Int. Cl.

| | |
|---|---|
| ***A45D 8/34*** | (2006.01) |
| ***A47F 5/00*** | (2006.01) |
| ***A47G 25/06*** | (2006.01) |
| ***A47F 7/14*** | (2006.01) |
| ***D06F 57/08*** | (2006.01) |
| ***A45D 44/04*** | (2006.01) |
| ***A45D 2/00*** | (2006.01) |

(52) U.S. Cl.
CPC ..... *A45D 8/34* (2013.01); *A45D 44/04* (2013.01); *A47F 5/0006* (2013.01); *A47F 7/143* (2013.01); *A47G 25/0685* (2013.01); *D06F 57/08* (2013.01); *A45D 2002/005* (2013.01)

(58) Field of Classification Search
CPC .... A45D 5/34; A45D 2002/005; A45D 44/04; A45D 44/02; A45D 44/14; A45D 8/34; A47B 43/00; D06F 57/08; D06F 57/06; A47F 7/02; A47F 7/12; A47F 7/19; A47F 7/17; A47F 5/0006; A47F 5/0815; A47F 7/143; A47F 5/10; A47F 5/135; A47G 25/06; A47G 25/0607; A47G 25/0664; A47G 25/0685
USPC ..... 211/13.1, 195, 106.01, 85.9, 85.2, 198, 211/85.5, 85.24, 85.3; 248/166, 439, 454, 248/441.1, 457, 460, 463, 464
See application file for complete search history.

(56) References Cited

U.S. PATENT DOCUMENTS 459,011 A * 9/1891 Mahin ..... A47F 5/0823 211/57.1
478,025 A * 6/1892 Schraudner ..... A47B 57/42 248/222.13
507,233 A * 10/1893 Marshall ..... A47F 5/13 211/85
574,509 A * 1/1897 Welter ..... A47G 25/06 211/106.01
609,116 A * 8/1898 McDonald ..... A47G 25/0685 211/100
611,503 A * 9/1898 Parker ..... A47G 25/0685 211/104
613,760 A * 11/1898 Cronin ..... 242/131.1
869,673 A * 10/1907 Wilson ..... D06F 57/08 211/198
959,685 A * 5/1910 Adlam ..... A01F 25/12 211/125
1,265,922 A * 5/1918 Lanier ..... A47B 23/042 211/2

(Continued)

*Primary Examiner* — Jennifer E. Novosad
(74) *Attorney, Agent, or Firm* — Dunlap Bennett & Ludwig, PLLC

(57) ABSTRACT

A hair braiding device dimensioned and adapted for enabling the separation of a plurality of braiding hair sections with minimum amounts of tangling and knotting, even when the underlying hair braiding device is moved. The hair braiding device provides a grid of hooks positioned at an operational orientation angle, even as the hair braiding device is movable between a deployed state and a collapsed state for transportation and storage. Thereby the operatively associated hair sections remain in their own spaced-apart relationship relative to each other.

8 Claims, 3 Drawing Sheets

(56) References Cited

U.S. PATENT DOCUMENTS 1,380,747 A * 6/1921 Stanford ..... A47G 29/10 211/1
1,394,947 A * 10/1921 Singer ..... A47J 47/16 211/41.2
1,554,211 A * 9/1925 Halevy ..... A47B 23/043 248/464
RE17,487 E * 11/1929 Heinz ..... A61G 17/04 248/27.8
1,896,654 A * 2/1933 Weaton ..... A47G 25/0685 211/99
1,955,509 A * 4/1934 Moeckel ..... A47F 5/13 211/85
1,968,644 A * 7/1934 Hickerson ..... D06F 57/08 211/198
D106,230 S * 9/1937 Fawcett ..... D6/682.6
D119,760 S * 4/1940 Kopp ..... D6/572
2,454,559 A * 11/1948 Kuehn ..... D06F 57/08 211/104
2,489,988 A * 11/1949 Taylor ..... A47F 7/17 242/139
2,588,529 A * 3/1952 Hume ..... B65H 49/16 242/139
2,598,614 A * 5/1952 Gilbert ..... A47G 25/743 211/113
D168,997 S * 3/1953 Horwitz ..... D6/680.2
2,950,003 A * 8/1960 Simmons ..... A45C 11/16 206/565
2,985,315 A * 5/1961 Paruolo ..... A47F 5/0876 211/189
3,070,235 A * 12/1962 Manzardo ..... A47G 29/10 211/85.9
3,153,872 A * 10/1964 Walter ..... G09F 15/0062 40/610
3,224,113 A * 12/1965 Goldsholl ..... G09F 5/04 434/98
3,388,806 A * 6/1968 Cunningham, Jr. ..... D01H 1/18 211/85.5
3,497,074 A * 2/1970 Shaheen ..... A47G 29/10 211/85.9
3,554,550 A * 1/1971 Schram ..... A63B 67/06 273/388
D220,271 S * 3/1971 Miles ..... D6/320
3,712,521 A * 1/1973 Tanner ..... D05B 91/14 223/107
D237,931 S * 12/1975 Brandenfels ..... D6/675.1
3,998,332 A * 12/1976 Lambertson ..... A47F 5/0838 211/71.01
4,029,318 A * 6/1977 Boss ..... F41J 1/10 273/390
D248,915 S * 8/1978 Brandenfels ..... D6/672
D286,964 S * 12/1986 Gecchelin ..... 108/30
4,666,038 A * 5/1987 Minneman ..... A63B 55/10 206/315.2
D291,031 S * 7/1987 Luongo ..... D6/317
4,684,091 A * 8/1987 Moreschi ..... F16M 11/046 211/182
4,775,053 A * 10/1988 Geiger ..... A47F 7/02 211/85.2
4,834,248 A * 5/1989 Lee ..... A47F 5/0876 211/113
4,872,963 A * 10/1989 Van Horn ..... C25D 13/22 204/297.09
D305,709 S * 1/1990 Blignaut ..... D6/682.6
D311,293 S * 10/1990 Edwards ..... D6/553
5,038,943 A * 8/1991 Reinke ..... A47F 5/083 211/181.1
D325,136 S * 4/1992 Lucht ..... D6/682.6
D331,344 S * 12/1992 Williams ..... D6/552
5,273,248 A * 12/1993 Grander ..... A47B 85/00 211/2
5,284,256 A * 2/1994 Correll-Antoun ..... A47B 63/00 211/198
D372,143 S * 7/1996 Selby ..... D3/315
5,531,334 A * 7/1996 Forby ..... B05B 13/02 118/500
D375,002 S * 10/1996 Sosso ..... D6/675.4
D377,427 S * 1/1997 Ashton, II ..... D6/570
5,853,092 A * 12/1998 Goodman ..... A47F 5/0823 211/70.6
5,921,407 A * 7/1999 Kabanek ..... A61B 50/20 211/65
6,196,396 B1 * 3/2001 Bennett ..... A47F 7/12 211/113
6,702,126 B2 * 3/2004 Park ..... A47F 5/0807 211/193
7,159,728 B2 1/2007 Smith
7,165,689 B2 1/2007 McDaniel
D538,065 S * 3/2007 Benson ..... D6/678.4
7,395,937 B2 * 7/2008 Sliwowski ..... A47F 5/0884 211/106.01
7,533,675 B2 5/2009 Takemura
7,712,641 B2 * 5/2010 Snyder ..... A47G 25/14 211/113
D622,084 S * 8/2010 Stukenberg ..... D6/682.6
7,775,377 B2 8/2010 Abney
7,798,463 B2 * 9/2010 Morgenroth ..... A47G 1/164 211/106.01
8,439,210 B1 5/2013 Griffith
8,657,124 B2 * 2/2014 Brown ..... A47G 29/00 211/113
D722,917 S * 2/2015 Anastasiadis ..... D11/132
8,998,002 B1 4/2015 Milner
D735,412 S * 7/2015 Coleman ..... D28/54
9,186,008 B2 * 11/2015 MacLaren ..... A47G 25/743
9,332,820 B2 5/2016 Bernard
D763,566 S * 8/2016 Fasino ..... D3/20
9,441,785 B2 9/2016 Sterling
9,492,021 B2 11/2016 Kebreau
9,622,596 B2 4/2017 Trainor-Smith et al.
2004/0020507 A1 2/2004 Johnson
2005/0103730 A1 * 5/2005 Hosilyk ..... A47F 7/17 211/85.5
2006/0005849 A1 1/2006 Thomas-Dupree
2006/0266721 A1 * 11/2006 Gregory ..... A47F 7/12 211/85.3
2008/0308511 A1 * 12/2008 Ruelas ..... A47G 25/14 211/85.3
2009/0008347 A1 1/2009 Bell
2009/0050588 A1 * 2/2009 Riley ..... A47F 7/02 211/85.2
2013/0104922 A1 * 5/2013 Hall ..... A45D 44/04 132/200
2014/0191093 A1 * 7/2014 Ceravolo ..... F16M 13/022 248/157

* cited by examiner

HAIR BRAIDING DEVICE

BACKGROUND OF THE INVENTION

The present invention relates to hair styling accessories and, more particularly, to a hair braiding device providing a structured grid of hooks positioned at an operational oriented angle for supporting a plurality of hair sections in a spaced apart relationship for the forming of braids and similar hairstyles that require separated braiding hair.

When performing hair styling services that requires braiding hair extensions, stylists of hair extensions (after feathering and separating the hair in small amounts, "sections") run into the issue of not having a proper space or tool for supporting the individual hair sections in a spaced apart relationship relative to each other so as to prevent tangling and other complications.

Though there are currently hair braiding tools, such tools allow portions of the separated hair to fall off the tool during the braiding process or if when the user temporarily suspends the braiding operation and moves the tool.

As can be seen, there is a need for a hair braiding device providing a structure for forming of braids and similar hairstyles that require separated braiding hair. The structure embodied by the present invention allows braiding stylists to properly place the separated hair on a very sturdy, reliable, and neat placement, while maintaining the separated hair even if the device is moved midway during the braiding operation. The present invention provides rows of spaced-apart hooks mounted at different elevations so that the extension hair placed thereon can be separated evenly, prevent tangling, knotting, or the loss of sectioned hair even if the structure were to be accidentally dropped. The hooks are movable between an operative state and a secured state, though throughout maintaining an operational orientation for securing operatively associated hair sections.

As a result, the present invention, unlike the prior art, is compact and portable, which makes it easy to store and place within a work-space, even when separated hair is still associated with the hair braiding device.

SUMMARY OF THE INVENTION

In one aspect of the present invention, a hair braiding device includes the following: a plurality of vertically spaced apart rows; a plurality of hooks horizontally spaced apart along each row; two first legs, each first leg connected to one of the two opposing end portions of each row, wherein the two first legs are supported by a supporting surface; and a support leg pivotably connected to an upper portion of each first leg so that the hair braiding device is movable between a deployed state and a collapsed state, wherein each hook is disposed in an operational oriented angle relative to the supporting surface, and wherein the operational oriented angle is thirty to sixty degrees.

In another aspect of the present invention, the hair braiding device including the following: a plurality of vertically spaced apart rows; a plurality of hooks horizontally spaced apart along each row; two first legs, each first leg connected to one of the two opposing end portions of each row, wherein the two first legs are supported by a supporting surface, wherein each row provides an engagement surface at each opposing end for engaging one of the two first legs, wherein each row provides a hook surface for connected to each hook provided thereon, and wherein the engagement surface is at an acute angle relative to the hook surface, ranging between thirty and sixty degrees; and a support leg pivotably connected to an upper portion of each first leg so that the hair braiding device is movable between a deployed state and a collapsed state, wherein each hook is disposed in an operational oriented angle relative to the supporting surface when the hair braiding device is in the deployed state or the collapsed state, wherein the operational oriented angle is approximately sixty degrees in the deployed state and approximately thirty degrees in the collapsed state.

These and other features, aspects and advantages of the present invention will become better understood with reference to the following drawings, description and claims.

DETAILED DESCRIPTION OF THE INVENTION

Figure 1:
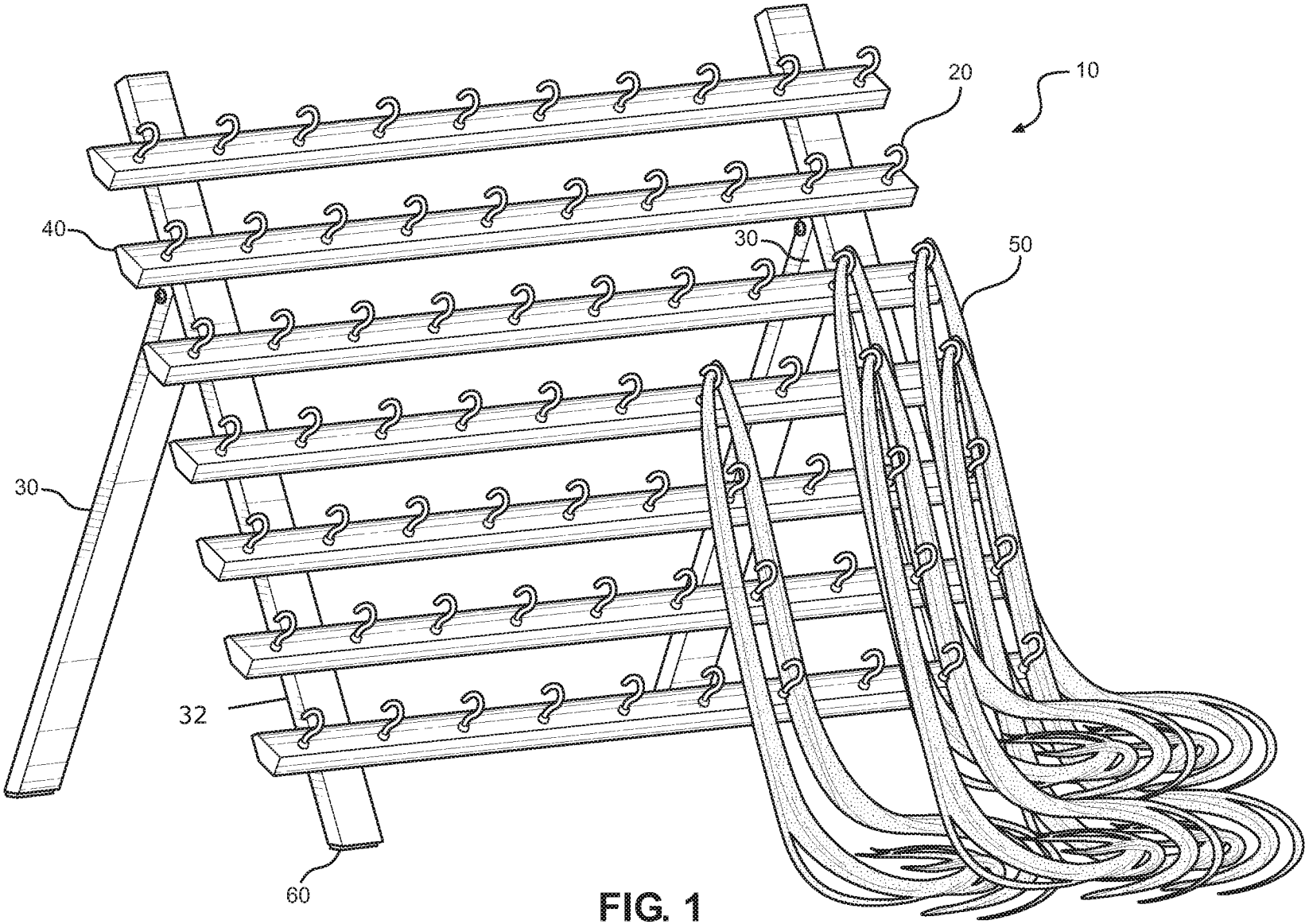
FIG. 1 is a perspective view of an exemplary embodiment of the present invention, shown in use; the stylist separates and hangs each hair sections needed on the rack hooks before beginning to braid with a client's hair; so that the hair sections are kept detangled and the stylist does not need to stop during braiding to create more.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a hair braiding device dimensioned and adapted for enabling the separation of a plurality of braiding hair sections with minimum amounts of tangling and knotting, even when the underlying hair braiding device is moved. The hair braiding device provides a grid of hooks positioned at an operational orientation angle, even as the hair braiding device is movable between a deployed state and a collapsed state for transportation and storage. Thereby the operatively associated hair sections remain in their own spaced-apart relationship relative to each other.

Referring to FIGS. 1 through 4, the present invention may include a hair braiding device 10. The hair braiding device 10 may provide a plurality of vertically spaced apart, parallel rows of hooks 40, each row 40 providing a plurality of horizontally spaced apart hooks 20. In certain embodiments, the hooks may be spaced apart between 0.5 and 1.5 inches.

The plurality of vertically spaced apart, parallel rows of hooks 40 may be supported by two spaced apart first legs 32 at or near each end of each row 40. The two first legs 32 act as a frame that extends to a supporting surface, such as the floor, where each first leg 32 may provide a padded and/or non-slip foot 60. A support leg 30 may be pivotably connected to an upper portion of each first leg 32 so that the hair braiding device 10 is movable between a deployed state, illustrated in FIG. 2, and a collapsed state, illustrated in FIG.

3, for storage or transport purposes. Each support leg 30 may terminate at a padded and/or non-slip foot 60.

Figure 3:
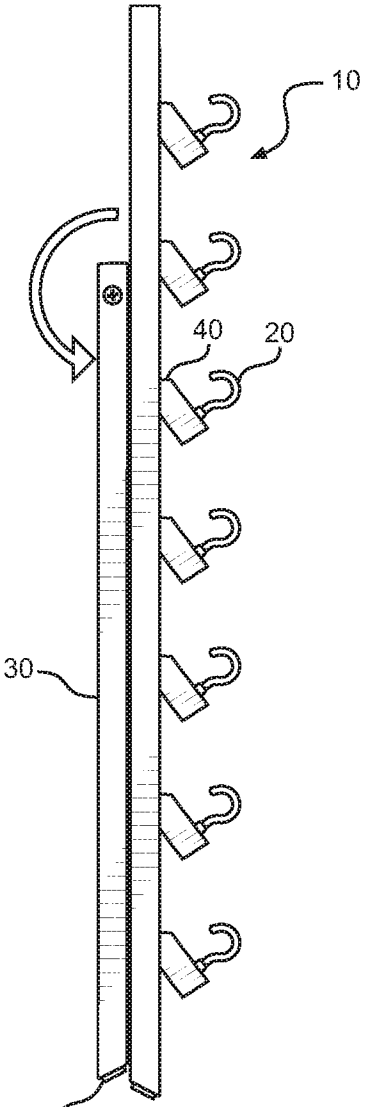
FIG. 3 is a side view of an exemplary embodiment of the present invention, illustrating the movement to a collapsed state for compact storage.

Each row 40 and/or hook 20 may be oriented in an operational orientation. The operational orientation may be angled between thirty and sixty degrees relative to the supporting surface, wherein the operational orientation is closer to sixty degrees in the deployed state and closer to thirty degrees in the collapsed state, as illustrated in FIGS. 2 and 3, respectively.

Figure 2:
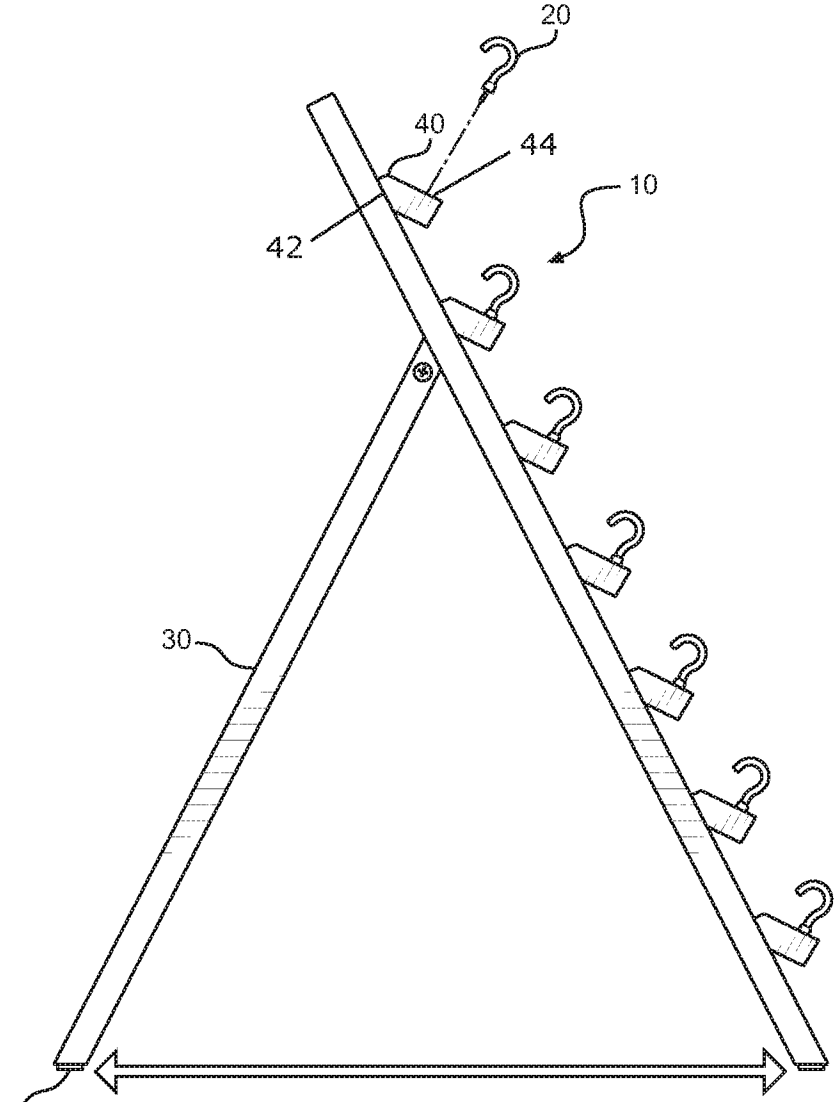
FIG. 2 is a side view of an exemplary embodiment of the present invention, illustrating the movement to a deployed state, with a hook shown exploded from a hook surface 44.
Figure 4:
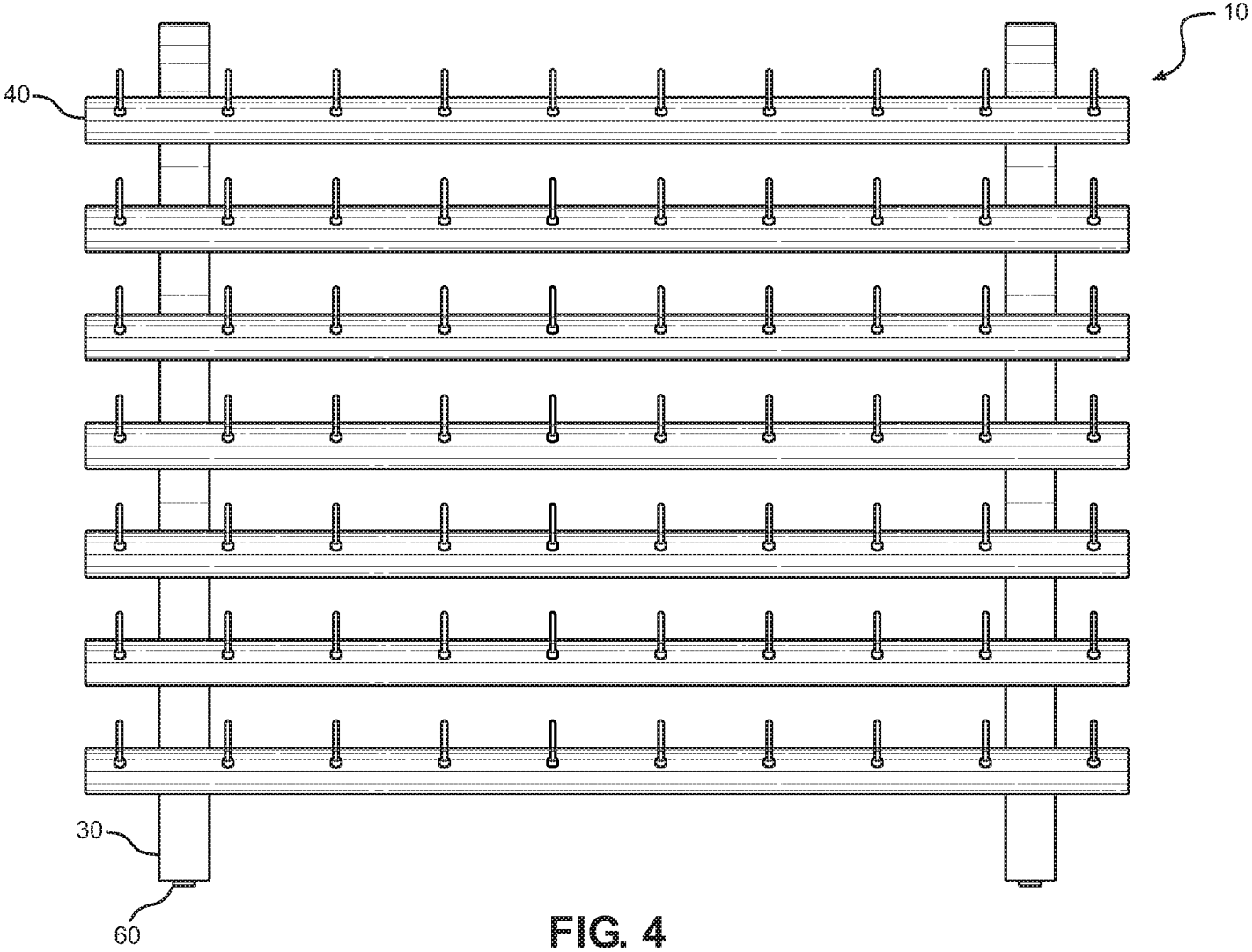
FIG. 4 is a front view of an exemplary embodiment of the present invention, shown in the deployed state with the hooks angled upward in the operational orientation for securely associating with hair sections.

Each row 40 may have a unique shape to facilitate such operational orientations, wherein the row 40 has a pentagonal profile, at least at the engagement of the row 40 and the first leg 32, or has at least an engagement surface 42 that is at an acute angle relative to a hook (supporting) surface 44, as illustrated in FIG. 2. The acute angle may range between thirty and sixty degrees.

Each row 40 may be approximately one inch in width and twelve to fifty inches in length, and the first legs 32 and the support legs 30 may have similar dimensions. Adjacent rows 40 may be vertically spaced apart by between one and four inches. The hooks 20 may be screw hooks or attachable pieces of material, curved or bent back at an angle, for catching hold of or hanging things on so as they are dimensioned to catch, hold and hang sections of hair 50, as illustrated in FIG. 1.

The hair braid device 10 forms a stand whereby the plurality of vertically spaced apart rows 40 each support a plurality of horizontally spaced apart hooks 10 enabling the separation of the braiding hair sections 50 to remain in its own space with minimum amounts of tangling and knotting. For example, assuming the stylist is conducting "single" braids or "plats" and each hook 20 would hold one braid section 50, the hair braiding device 10 stand can hold at least sixty braids 50. This allows the stylist to complete a client's full head of single braids 50 without having to stop multiple times to sort and separate hair that is needed. With the separation of the hair being evenly distributed on the hair braiding device 10, the braids 50 will be more sequential on the client's head, allowing the style to be more desirable to the client.

It should be understood, of course, that the foregoing relates to exemplary embodiments of the invention and that modifications may be made without departing from the spirit and scope of the invention as set forth in the following claims.

What is claimed is:

1. A hair braiding device, comprising:

a plurality of vertically spaced apart rows;

a plurality of hooks horizontally spaced apart along each row;

two first legs, each first leg connected to one of two opposing end portions of each row;

a support leg pivotably connected to an upper portion of each first leg so that the hair braiding device is movable between a deployed state and a collapsed state; and each leg has a distal end adapted to engage a supporting surface, wherein each hook is disposed in an operational oriented angle relative to the supporting surface, and wherein the operational oriented angle is thirty to sixty degrees, and wherein each row provides an engagement surface at each opposing end portion for engaging one of the two first legs, wherein each row provides a hook surface for connected to each hook provided thereon, and wherein the engagement surface is at an acute angle relative to the hook surface.

2. The hair braiding device of claim 1, wherein each hook is disposed in the operational oriented angle when the hair braiding device is in the deployed state or the collapsed state.

3. The hair braiding device of claim 2, wherein the operational oriented angle is approximately sixty degrees in the deployed state and approximately thirty degrees in the collapsed state.

4. The hair braiding device of claim 1, wherein the acute angle ranges between thirty and sixty degrees.

5. The hair braiding device of claim 1, wherein each row provides a pentagonal profile where said row interfaces with one of the two first legs.

6. The hair braiding device of claim 1, wherein each distal end has no-slip pads.

7. A hair braiding device, comprising:

a plurality of vertically spaced apart rows;

a plurality of hooks horizontally spaced apart along each row;

two first legs, each first leg connected to one of two opposing end portions of each row, wherein each row provides an engagement surface at each opposing end portion for engaging one of the two first legs, wherein each row provides a hook surface for connected to each hook provided thereon, and wherein the engagement surface is at an angle ranging between thirty and sixty degrees relative to the hook surface;

a support leg pivotably connected to an upper portion of each first leg so that the hair braiding device is movable between a deployed state and a collapsed state; and each leg has a distal end adapted to engage a supporting surface, wherein each hook is disposed in an operational oriented angle relative to the supporting surface when the hair braiding device is in the deployed state or the collapsed state, wherein the operational oriented angle is approximately sixty degrees in the deployed state and approximately thirty degrees in the collapsed state.

8. The hair braiding device of claim 7, wherein each distal end has no-slip pads.

* * * * *